US005131111A

United States Patent [19]

Richardson et al.

[11] Patent Number: 5,131,111

[45] Date of Patent: Jul. 21, 1992

[54] BUTTERFLY MOP

[76] Inventors: Holly M. Richardson, 133 N. Maple, Burbank, Calif. 91505; Betty J. Ross, 15012 Valerio St., Van Nuys, Calif. 91405

[21] Appl. No.: 682,096

[22] Filed: Apr. 5, 1991

[51] Int. Cl.[5] ..... B08B 13/00

[52] U.S. Cl. ..... 15/119 A; 15/244.1

[58] Field of Search ..... 15/119 A, 105, 244.1

[56] References Cited

U.S. PATENT DOCUMENTS

| | | | |
|---|---|---|---|
| 2,730,744 | 1/1956 | Vaughn | 15/119 A |
| 2,877,478 | 3/1959 | Kohlwey et al. | 15/119 A |
| 2,897,528 | 8/1959 | Greenleaf | 15/119 A X |
| 2,926,373 | 3/1960 | Knapp | 15/119 A |
| 2,959,799 | 11/1960 | Greenleaf et al. | 15/119 A |
| 3,147,502 | 9/1964 | Richards | 15/119 A X |
| 4,509,224 | 4/1985 | Batchelor | 15/119 A X |
| 4,928,341 | 5/1990 | Pacione | 15/119 A X |

*Primary Examiner*—Chris K. Moore

*Attorney, Agent, or Firm*—John J. Connors

[57] ABSTRACT

Disclosed is a butterfly mop with a sponge holder having a pair of wing members that can move through 180° rotation to allow a sponge member attached to the sponge holder to be folded inwardly upon itself and compressed or folded outwardly upon itself into a compact structure with the underside of the sponge member exposed.

6 Claims, 3 Drawing Sheets

BUTTERFLY MOP

BACKGROUND OF THE INVENTION

1. Field of the Invention

This invention relates to butterfly mops. In particular, to a butterfly mop where the sponge member of the mop is adapted to be either folded inwardly upon itself and compressed or folded outwardly upon itself into a compact structure with the underside of the sponge member exposed.

2. Background Discussion

Butterfly mops are conventional cleaning devices which include a handle having mounted at one end a sponge member which is adapted to be folded approximately in half and squeezed to remove water contained in the pores of the sponge. A typical mops are illustrated in the following patents:

| Inventor | Patent No. |
|---|---|
| J. Palama, Jr., et al | 2,685,098 |
| P. S. Vosbikian et al | 2,725,585 |
| H. Gantz | 2,730,741 |
| W. H. Richards, et al | 2,757,398 |
| F. Zottola | 2,730,743 |
| F. Zottola | 2,858,557 |
| P. S. Vosbikian, et al | 2,883,689 |
| A. E. Clements | 2,896,235 |
| F. B. Zottola | 2,916,754 |
| W. H. Richards | 2,967,317 |
| P. A. Morgan | 3,050,761 |
| W. H. Richards | 3,147,502 |
| K. Morrison, et al | 4,831,677 |
| D. A. Jones | 4,864,675 |
| U.K. Patent | 793,981 |

Prior art butterfly mops are characterized by complicated, mechanical structure to compress the sponge member. Such complex mechanical structure is bulky, costly to manufacture, and impossible to use in narrow recesses. As a general rule, these butterfly mops are only designed to compress the sponge member and do not fold the sponge member outwardly upon itself to expose substantially all of the underside of sponge member when so folded. This has not been recognized as a desirable attribute of butterfly mops until the present invention.

SUMMARY OF THE INVENTION

It is the object of the present invention to provide a butterfly mop which has a simplified mechanism for compressing the sponge member that also allows the sponge member to be folded outwardly upon itself to expose the underside of the sponge member. This provides a compact structure that fits into a narrow recess normally inaccessible to conventional mops and that has a cleaning surface available for wiping the surfaces of the recess.

The device of this invention has several features, no single one of which is solely responsible for its desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENT," one will understand how the features of this invention provide its advantages, which include compactness, simplicity of construction, and convenience and versatility of use.

The first feature is that the mop has a sponge holder comprising a pair of wing members having spring-biased hinges which enable the wing members to rotate 90° either towards the handle or away from the handle. The spring-biased hinges normally position the wing members at a right angle with respect to the handle. This normal position is used for most cleaning applications.

The second feature is a clevis which moves towards and away from the wing members between a normal position and a forward position or a retracted position. In the normal position, the clevis engages the wing members to maintain these members at a right angle with respect to the handle. In the forward position, the clevis engages the wing members to force these members to pivot inwardly about the hinges to compress the sponge member. In the retracted position, the clevis disengages from contact with the wing members to permit these members to pivot outwardly so that the underside surface of the sponge member is exposed when the wing members are folded outwardly towards each other.

The third feature is a clevis-positioning assembly, including a sleeve through which the handle passes. The sleeve has an internal track with opposed ends and a bend between the ends. The sleeve is mounted to rotate relative to the handle. The handle has a button which rides along the track. The button is located at the bend when the clevis is in the normal position. The sleeve is rotated in one direction and moved towards the wing members to dislodge the button from the bend and allow the button to ride in the track as the clevis is moved to the forward position. The sleeve is rotated in the opposite direction and moved rearwardly away from the sponge holder to dislodge the button from the bend and allow it to ride in the track as the clevis is moved to the retracted position.

The forth feature is that the wing members with a sponge member mounted thereon upon being folded have a combined thickness which is less than two inches. This enables the mop of this invention to access narrow recesses and passageways. Thus with the mop so folded and the underside of the sponge completely exposed, the user inserts the sponge member into the recess and wipes the recess surfaces with the underside of the folded sponge.

BRIEF DESCRIPTION OF THE DRAWING

The preferred embodiment of this invention, illustrating all its features, will now be discussed in detail. This embodiment depicts the novel and non-obvious butterfly mop of this invention shown in the accompanying drawing, which is for illustrative purposes only. This drawing includes the following figures (FIGS.), with like numerals indicating like parts.

DESCRIPTION OF THE PREFERRED EMBODIMENT

Figure 1:
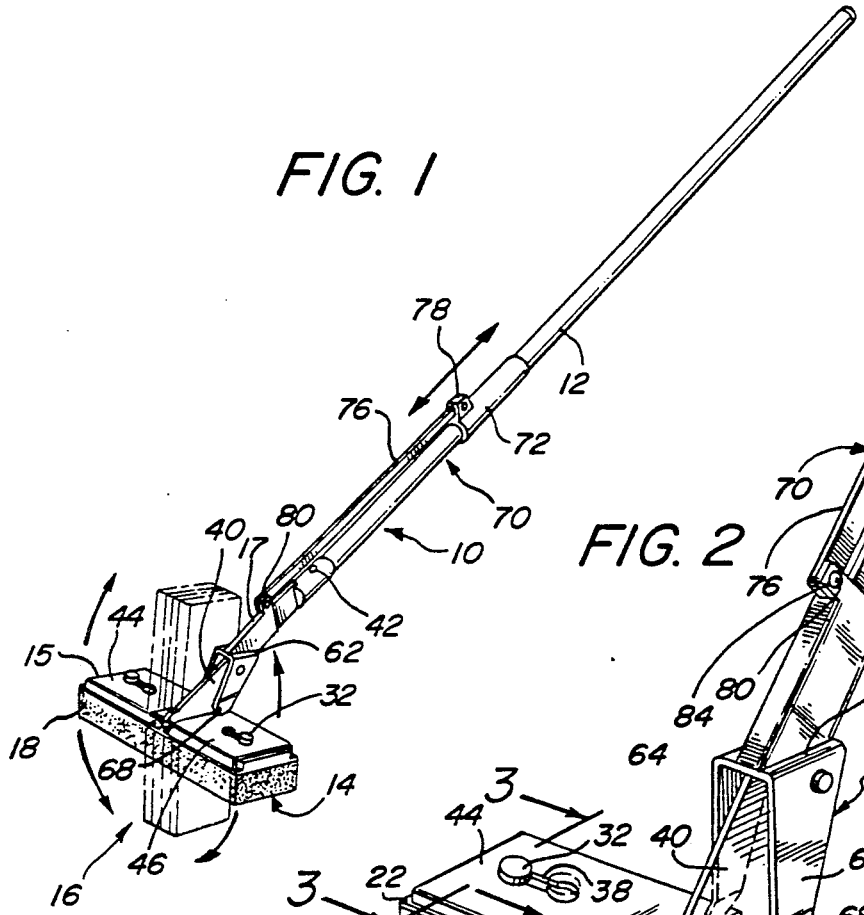
FIG. 1 is a perspective view of the butterfly mop of this invention.
Figure 2:
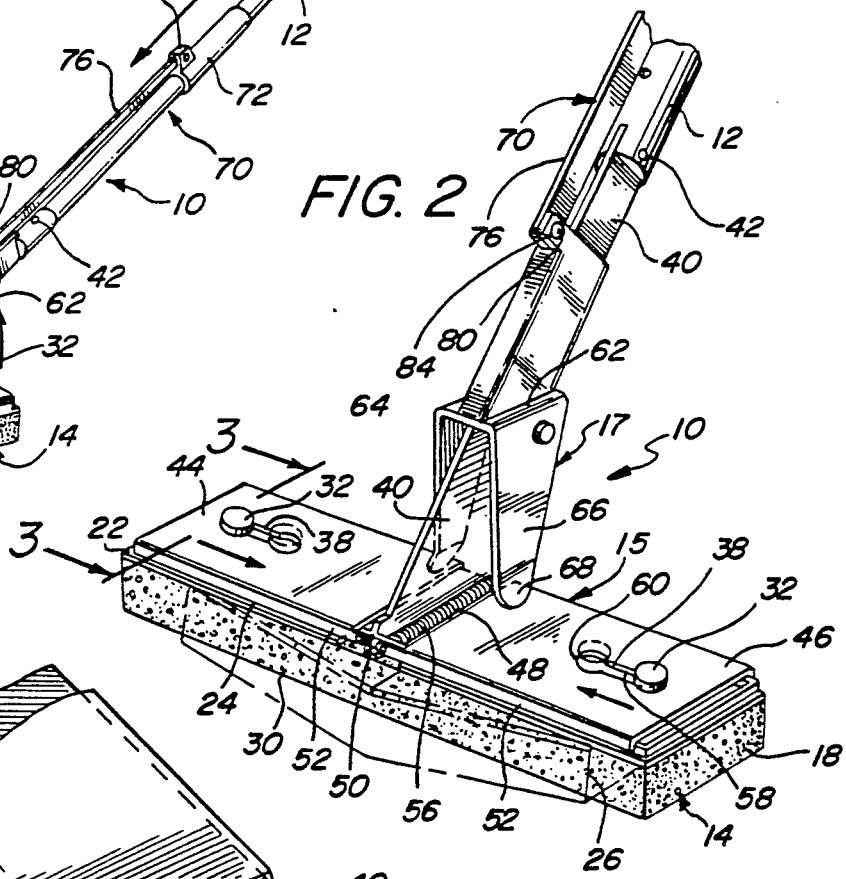
FIG. 2 is an enlarged fragmentary perspective view showing the head end of the mop.
Figure 3:
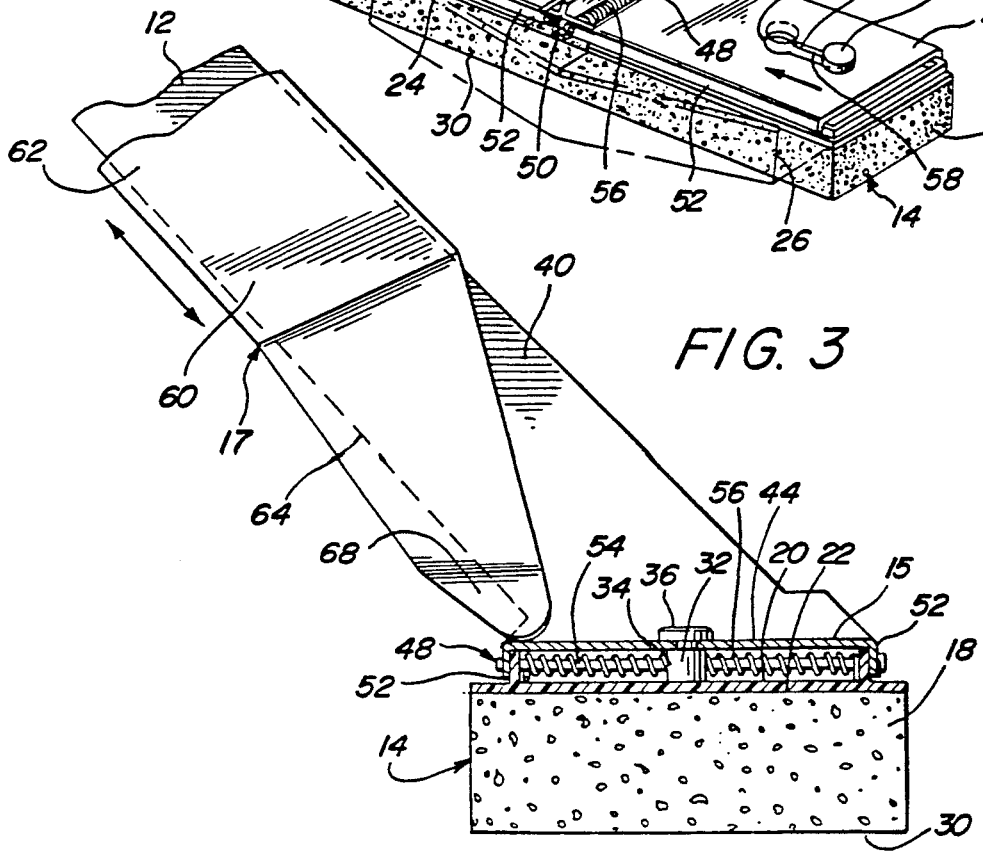
FIG. 3 is a cross-sectional view taken along line 3—3 of FIG. 2.

As illustrated in FIGS. 1 through 3, the butterfly mop 10 of this invention includes a handle 12 with a sponge member 14 removably attached to a sponge holder 15 at the head end 16 of the handle. The sponge holder 15 coacts with a manually movable clevis 17 to allow the sponge member 14 to be folded into the different positions illustrated in FIGS. 4 and 5.

Figure 13:
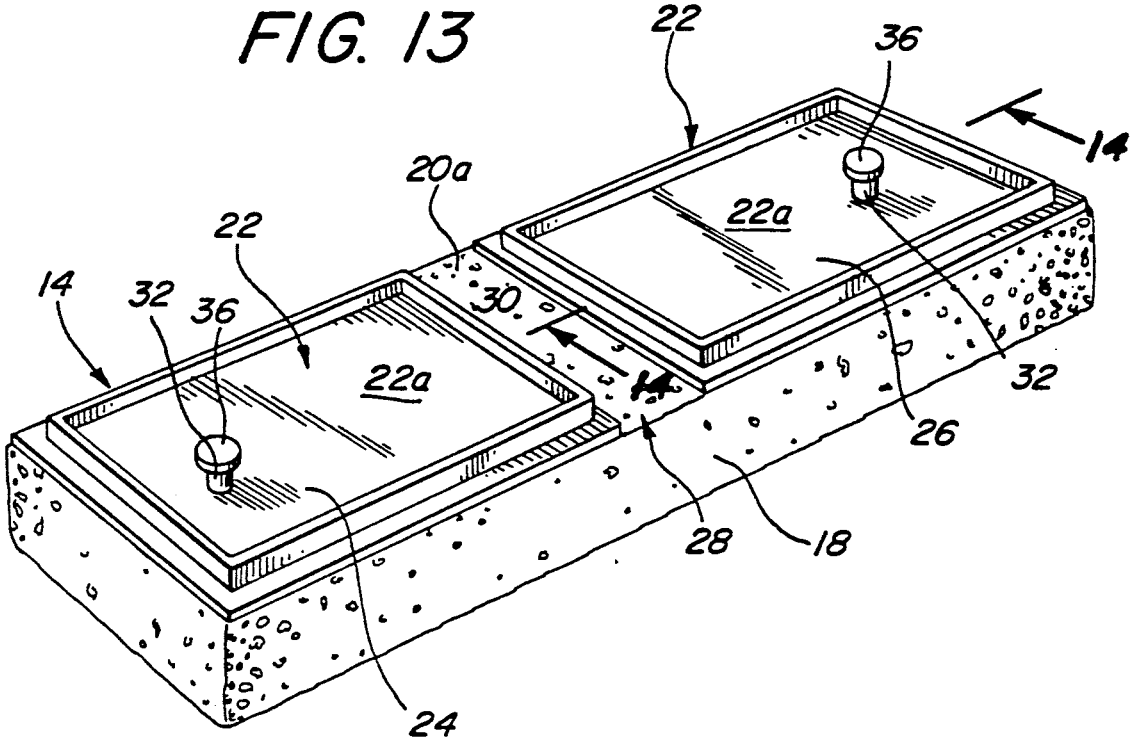
FIG. 13 is a perspective view of the sponge member of this invention.
Figure 14:
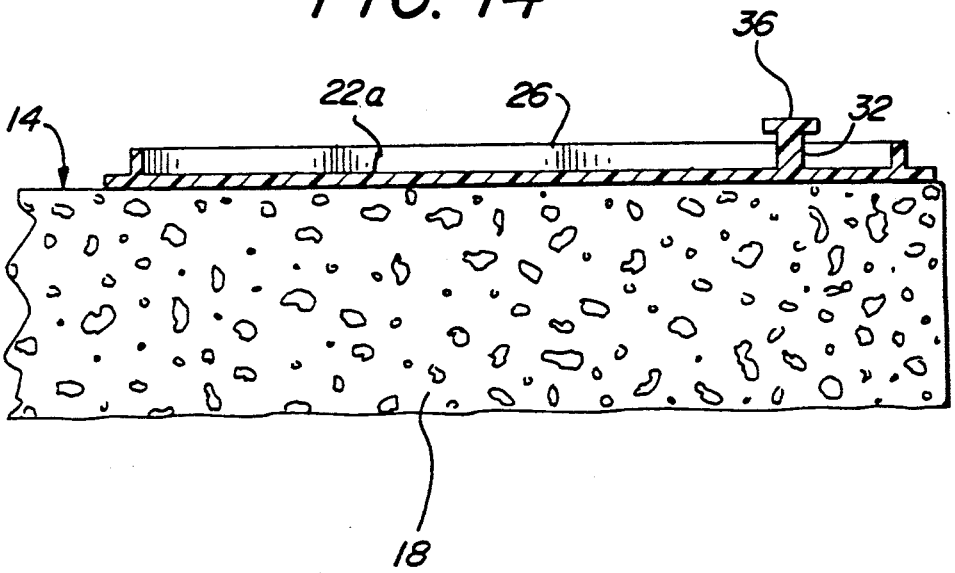
FIG. 14 is a cross-sectional view taken along line 14—14 of FIG. 13.

The sponge member 14 includes a rectangular block 18 of resilient synthetic sponge material, which has its upper surface 20 (FIG. 13) secured by an adhesive to the underside of a bifurcated carrier 22. This carrier 22 has two sections 24 and 26 spaced apart to provide a narrow gap 28 between proximal ends of these sections. The gap 28 exposes a central portion 20*a* (FIG. 4) of the upper surface 20 of the sponge block 18, but the sections 24 and 26 cover substantially all the remaining upper surface 20 the sponge block. The underside surface 30 of the sponge block 18 is completely uncovered.

Each section 24 and 26 of the carrier 22 has an outwardly extending pin 32 near a distal end of each section. Each pin 32 has a shaft 34 terminating in an enlarged head 36. Because of this construction, the carrier sections 24 and 26 are adapted to bend inwardly towards each other as illustrated in FIG. 2 to align the pins 32 with receptacles 38 in the sponge holder 15. The pins 32 each co-act with the receptacles 38 to removably attach the sponge member 14 to the sponge holder 15. The carrier sections 24 and 36 are injection molded from a polymeric material with the pins being integral with the base 22*a*. The sponge member 14 is adapted to be attached to the sponge holder 15 whether the sponge block 18 is dry or wet, because of the resiliency of the sponge block.

Figures 4, 5, 6, 7, 8, 9, 10, 11, 12:
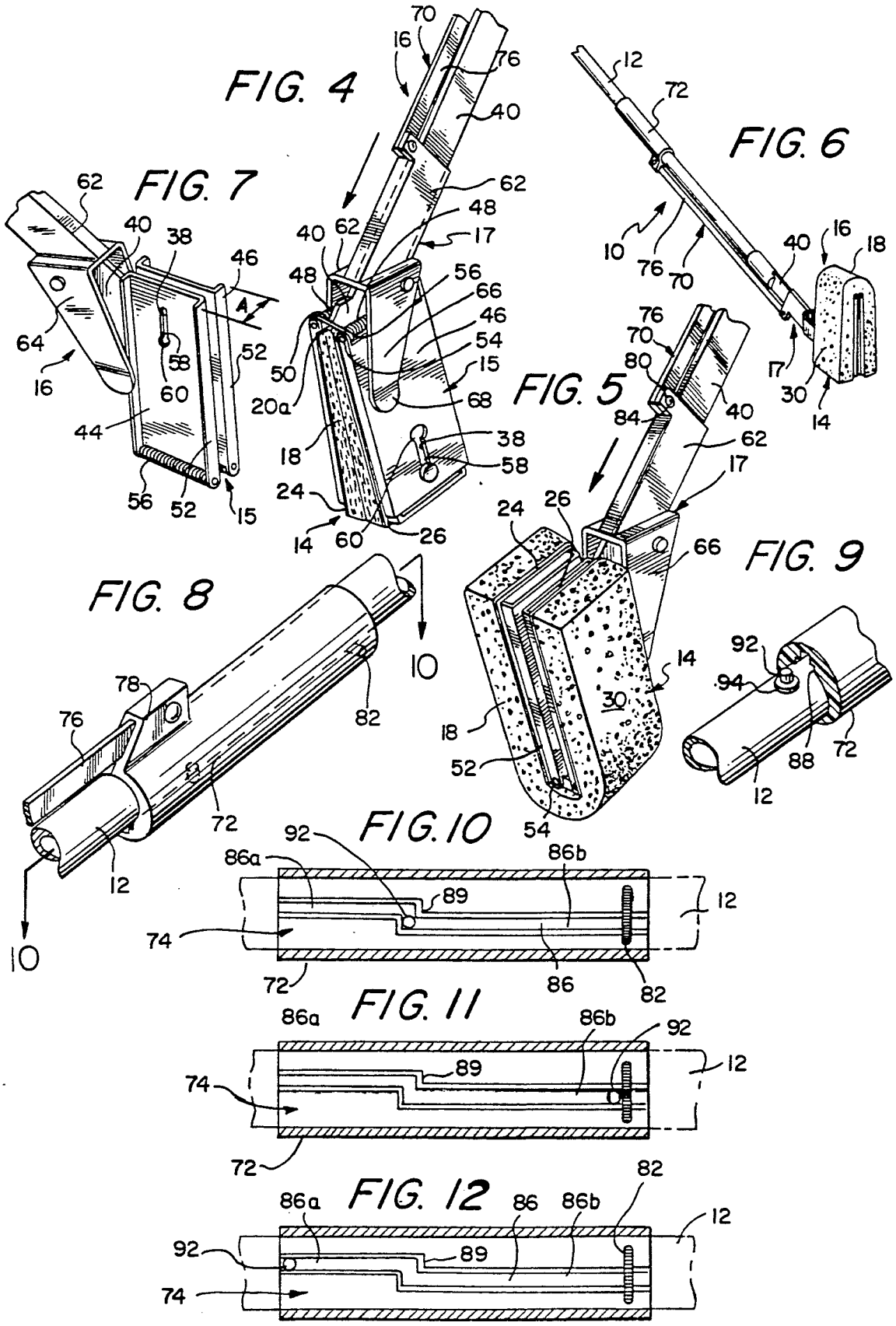
FIG. 4 is an enlarged fragmentary perspective view of the head end of the mop, with the clevis moved to the forward position.
FIG. 5 is an enlarged fragmentary perspective view of the head end of the mop, with the clevis moved to the retracted position.
FIG. 6 is a fragmentary perspective view of head end of the mop in an inverted position and the clevis moved forward to hold the sponge member in the outwardly folded position.
FIG. 7 is a fragmentary perspective view of the head end of the mop, with the sponge member removed, the wing members folded upwardly, and the clevis in the forward position to hold the wing members in this position.
FIG. 8 is a fragmentary perspective view of a portion of the handle of the mop, showing the sleeve which is manually moved to control the position of the clevis.
FIG. 9 is a fragmentary perspective view of a segment of the handle of the mop inverted to show a button which rides in a track in the sleeve shown in FIG. 6.
FIG. 10 is a cross-sectional schematic view showing the position of the button relative to the track when the clevis is the normal position.
FIG. 11 is a cross-sectional schematic view showing the position of the button relative to the track when the clevis is the retracted position.
FIG. 12 is a cross-sectional schematic view showing the position of the button relative to the track when the clevis is the forward position.

The sponge holder 15 has a central T-shaped clevis mount 40, having its upper end attached by a rivet 42 to the handle 12, and a pair of wing members 44 and 46 attached at their proximal ends by spring-biased hinges 48 to the base 50 of the clevis mount 40. The hinges 48 are designed to enable the wing members 44 and 46 to fold upon themselves as illustrated in FIGS. 4 and 5. The hinges 48 normally position the sponge member 14 in a conventional cleaning orientation as shown is FIG. 2. The manually actuated clevis folds the sponge member 14 inwardly upon itself into the position shown in FIG. 4 to compress the sponge block 18 and squeeze water from it, or allows the sponge member to be folded outwardly upon itself into the position shown in FIG. 5 to expose the underside surface 30 of the sponge block when in this outwardly folded position. The hinges 48 are designed to allow the wing members 44 and 46 to rotate through an angle of about 90° in either direction from the normal position shown in FIG. 2 for a total of about 180 degrees of rotation.

Each wing member 44 and 46 has along opposed edges a downwardly extending flange 52. Rods 54 (FIG. 3) extending between opposed flanges 52 carry springs 56 coiled around the rods. The springs 56 normally position the wing members 44 and 46 so these wing members are generally at a right angle with respect to the clevis mount 40 as shown in FIG. 2. The receptacles 38, near the distal ends of the wings members 44 and 46, each include a narrow channel 58 which terminates in an enlarged opening 60 which is near the proximal end of a wing member.

The clevis 17 straddles the clevis mount 40 which has its one end attached to the head end 16 of the handle 12. This clevis 17 includes a U-shaped open channel segment 60, having a connector section 62 at one end and a pair of downwardly extending legs 64 and 66 with the clevis mount between them. In the normal position shown in FIG. 2, the feet 68 of these legs 64 and 66 engage the top surface of the wing members 44 and 46 adjacent the hinges 48.

A clevis-positioning assembly 70 is used to move the clevis 17 from the normal position shown in FIG. 2, to the forward position shown in FIG. 4 and a retracted position. The clevis positioning assembly 70 includes a two piece sleeve 72 having a hollow center 74 through which the handle 12 passes, and a rigid arm 76 which is securely attached at one end to a connector section 78 (FIGS. 1 and 8) of the sleeve 72 and at the other end to a connector section 80 of the clevis connector section 62. The sleeve 72 is adapted to move laterally to and fro along the length of the handle 12 or to rotate, either clockwise or counterclockwise, about the handle. The arm 76 has sufficient flexibility to allow the sleeve 72 to rotate and is sufficiently rigid so it may push or pull the clevis 17 as the sleeve is moved laterally along the length of the handle 12.

The two pieces of the sleeve 72 are attached by a screw 82 (FIGS. 8 and 10 through 12) and a rivet 84 in the connector section 80. As illustrated in FIGS. 10 through 12, the assembled pieces of the sleeve 72 form an internal track 86 having a intermediate bend 89 between the opposed ends of the track and two opposed flights 86*a* and 86*b*. The track 86 is formed in the internal wall of the sleeve by a counterbore 88 adjacent a slot 90 shown in FIG. 9. A button 92 is securely attached to the handle 12 and has a washer 94 at its base. The button 92 rides in the slot 90 and the washer 94 rides in the counterbore 88 as the sleeve 72 is moved towards and away from the head end 16 of the mop 10. The screw 82 serves as a stop for the button 92 as it moves towards the one end of the track 86.

When the clevis 17 is in its normal position as shown in FIG. 2, the wing members 44 and 46 of the sponge holder 15 are extending outwardly and the button 92 is at the bend 89 of the track 86 as illustrated in FIG. 10. With the sponge block 18 resting on a floor, when the user applies downward pressure towards the head end 16 of the mop 10, the button 92 remains lodged in position in the bend 89 and the feet 68 of the clevis 17 engage the top surface of the wing members 44 and 46 to maintain these members in their normal position as illustrated in FIG. 2. Sufficient rigidity is thus provided so that the sponge member 14 is held in the position shown in FIG. 2 and functions in the conventional manner.

When the user is ready to compress the sponge member 14, the sleeve 72 is rotated to move the button 92 into alignment with the front flight 86*a* of the track 86. The user then pushes the sleeve 72 forward as illustrated by the arrow in FIG. 4. This moves the arm 76 downwardly to push the clevis 17 against the wing members 44 and 46 to fold these wing members inwardly about the hinges 48 as shown in FIG. 4. This compresses the sponge block 18 between the wing members 44 and 46 to squeeze water from the sponge block. The clevis 17 may be left in this position illustrated in FIG. 4 to store the mop 10. Upon moving the sleeve 72 away from the head end 16 of the mop 10, the button 92 rides along the front flight 86*a* of the track until it engages the bend 89. At this point, the user rotates the sleeve 72 to lodge the button between the walls forming the bend 89 as indicated in dotted lines. Upon disengaging the clevis 17 from the wing members 44 and 46, the springs 56 of the hinges 48 return the wing members to the normal position as illustrated in FIG. 2. Upon rotation of the sleeve 72 slightly as shown in FIG. 12 to bring the button 92 into alignment with the rear flight 86*b* of the track 86, and pulling the sleeve inwardly to move it towards the tail end of the mop 10, the clevis 17 is lifted away from the wing members 44 and 46. This enables the wing members 44 and 46 to be folded outwardly as illustrated in FIG. 5 to expose the underside surface 30 of the sponge block 18 in the outwardly folded position. The wing members 44 and 46 may be folded outwardly by simple forcing them into a narrow recess or by grasping them and manually folding them outwardly. The clevis 17 may be moved to its forward position where the feet 68 will now grasp between them the folded wing members 44 and 46 as illustrated in FIG. 7 to hold the sponge member 14 in the outwardly folded position illustrated in FIG. 5. The total width A of the wing members 44 and 46 when folded either inwardly or outwardly is less than two inches, typically one and one-third of an inch, including the sponge member 14. With the sponge holder 14 in the position shown in FIG. 5, the mop 10 can be used to access narrow passageways (for example, between a wall and a refrigerator).

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. A mop including a handle, sponge holder means having a central mounting element attached to the handle and a pair of wing members adapted to hold a sponge, each wing member having a proximal end attached by spring biased hinge means to the central mounting element to rotated about 90° either towards the handle or away from the handle, said spring biased hinge means normally positioning the wing members at a right angle with respect to the central mounting element, wing positioning means mounted on the handle to move towards and away from the wing members between a forward position, a normal position, and a retracted position, said wing positioning means in the forward position engaging the wing members to force said wing members to pivot inwardly about the hinge means and compress between said wing members a sponge mounted to said wing members, said wing positioning means in the normal position engaging the wing members to maintain said wing members at a right angle with respect to the central mounting element during use of the mop, and said wing positioning means in the retracted position disengaging from contact with the wing members to permit said wing members to pivot outwardly about the hinge means so that the underside of a sponge mounted on said wing members is exposed, and actuator means carried on the handle at a position remote from the sponge holder means and connected to the wing positioning means which is manually actuated to locate said wing positioning means in one of said forward, normal and retracted positions.

2. The mop of claim 1 wherein the actuator means includes a sleeve member through which the handle passes, said sleeve member having an internal track with opposed ends and a bend between the ends, and means for mounting the sleeve to rotate relative to the handle including a button element carried by the handle which rides along said track, said button element being lodged in the bend when the wing positioning means is in the normal position, with the sleeve being rotated in one direction and moved towards the sponge holder means to dislodge the button element from the bend and allowing said button element to ride in the track as the wing positioning means is moved to the forward position, and the sleeve being rotated in the opposite direction and moved rearwardly away from the sponge holder means to dislodge the button element from the bend and allowing said button element to ride in the track as the wing positioning means is moved to the retracted position.

3. A mop including
a handle,
sponge holder means having
a central mounting element attached to the handle and a pair of wing members adapted to hold a sponge,
each wing member having an upper surface and a proximal end attached by spring biased hinge means to the central mounting element to rotated about 90° either towards the handle or away from the handle,
said spring biased hinge means normally positioning the wing members at a right angle with respect to the central mounting element,
wing positioning means on the handle having a pair of legs including feet adapted to engage the wing members and adapted to move towards and away from the wing members between a forward position, a normal position, and a retracted position, with the legs straddling the central mounting element and the feet engaging the upper surface of the wing members when in the normal position and the wing members disposed between the legs of the wing positioning means when in the forward position,
said wing positioning means in the forward position engaging the wing members to force said wing members to pivot inwardly about the hinge means and compress between said wing members a sponge mounted to said wing members,
said wing positioning means in the normal position engaging the wing members to maintain said wing members at a right angle with respect to the central mounting element during use of the mop, and
said wing positioning means in the retracted position disengaging from contact with the wing members to permit said wing members to pivot outwardly about the hinge means so that the underside of a sponge mounted on said wing members is exposed, and
actuator means carried on the handle at a position remote from the sponge holder means and connected to the wing positioning means which is manually actuated to locate said wing positioning means in one of said forward, normal and retracted positions.

4. A mop comprising
a handle,
means for removably attaching a sponge member to an end of the handle, and
means for squeezing liquid from the sponge member by folding the sponge member in a first direction about the axis of the handle through an angle of about 90 degrees so that thickness of the folded sponge member is less than about two inches,
said sponge member also being adapted to be folded in a second direction opposite said first direction through an angle of about 90 degrees about the axis of the handle, so that the thickness of the sponge member folded in the second direction is less than about two inches.

5. The mop of claim 4 including a manually actuated member which is adapted to hold the folded sponge member in the folded position.

6. A mop including
a handle,
sponge holder means having
a central mounting element attached to the handle and a pair of wing members adapted to hold a sponge,
each wing member having a proximal end attached by spring biased hinge means to the central mounting element to rotated about 90° either towards the handle or away from the handle,
said spring biased hinge means normally positioning the wing members at a right angle with respect to the central mounting element,
said wing members with a sponge member mounted thereon upon being folded about the central mounting element having a combined thickness which is less than two inches,
wing positioning means mounted on the handle to move towards and away from the wing members between a forward position, a normal position, and a retracted position,
said wing positioning means in the forward position engaging the wing members to force said wing members to pivot inwardly about the hinge means and compress between said wing members a sponge mounted to said wing members,
said wing positioning means in the normal position engaging the wing members to maintain said wing members at a right angle with respect to the central mounting element during use of the mop, and
said wing positioning means in the retracted position disengaging from contact with the wing members to permit said wing members to pivot outwardly about the hinge means so that the underside of a sponge mounted on said wing members is exposed, and
actuator means carried on the handle at a position remote from the sponge holder means and connected to the wing positioning means which is manually actuated tc locate said wing positioning means in one of said forward, normal and retracted positions,
said actuator means including
a sleeve member through which the handle passes,
said sleeve member having an internal track with opposed ends and a bend between the ends, and
means for mounting the sleeve to rotate relative to the handle including a button element carried by the handle which rides along said track,
said button element being lodged in the bend when the wing positioning means is in the normal position, with the sleeve being rotated in one direction and moved towards the sponge holder means to dislodge the button element from the bend and allowing said button element to ride in the track as the wing positioning means is moved to the forward position, and the sleeve being rotated in the opposite direction and moved rearwardly away from the sponge holder means to dislodge the button element from the bend and allowing said button element to ride in the track as the wing positioning means is moved to the retracted position, and
an arm member connecting the sleeve to the wing positioning means which has sufficient flexibility to allow the sleeve to rotate and is sufficiently rigid to allow the arm to push or pull the wing positioning means as the sleeve is moved laterally.

* * * * *